United States Patent [19]

Jacobs

[11] 4,123,049

[45] Oct. 31, 1978

[54] PRINTING PLATE TRANSFER APPARATUS

[75] Inventor: Robert D. Jacobs, Geneseo, N.Y.

[73] Assignee: Itek Corporation, Lexington, Mass.

[21] Appl. No.: 774,301

[22] Filed: Mar. 4, 1977

[51] Int. Cl.[2] ..... B65H 5/02; B65H 5/18; B65H 9/00

[52] U.S. Cl. ..... 271/225; 198/412; 198/489; 198/631; 214/1 BD; 214/147 T; 271/185; 271/198

[58] Field of Search ..... 271/184, 185, 225, 198; 198/406, 408, 412, 409, 379, 631, 489; 214/1 BD, 147 T

[56] References Cited

U.S. PATENT DOCUMENTS

| | | | |
|---|---|---|---|
| 770,486 | 9/1904 | White | 271/225 UX |
| 3,019,018 | 1/1962 | Hasselquist | 198/412 X |
| 3,367,517 | 2/1968 | Dallape et al. | 214/1 Q |

FOREIGN PATENT DOCUMENTS

| | | | |
|---|---|---|---|
| 523,598 | 1/1956 | Belgium | 198/489 |

OTHER PUBLICATIONS

Creedon, J.M. et al., "Card Feed System," IBM Technical Disclosure Bulletin, vol. 14, No. 1, Jun. 1971, p. 136.

*Primary Examiner*—Bruce H. Stoner, Jr.
*Attorney, Agent, or Firm*—Homer O. Blair; Robert L. Nathans; Gerald H. Glanzman

[57] ABSTRACT

Transfer apparatus for receiving a printing plate from a first station in a first horizontal orientation and for transferring the plate to a second station in a second orientation which is both vertical and rotated 90° relative to the first orientation. The apparatus comprises a receptor bin for supporting the plate, which receptor bin is, in turn, supported solely by a single rotatable shaft. By mounting the shaft to the receptor bin at a precise angular orientation, rotation of the shaft about its own axis will carry the receptor bin and the plate supported on it from the first orientation to the second orientation to transfer the plate to the second station.

13 Claims, 6 Drawing Figures

PRINTING PLATE TRANSFER APPARATUS

BACKGROUND OF THE INVENTION

1. Field of the Invention

The present invention relates generally to the field of document handling apparatus. More particularly, the invention relates to a printing plate transfer apparatus movable, in a novel manner, from a first horizontal plane input position to receive a plate from a first station to a second vertical and rotated plane output position for transferring the plate to a second station.

2. Description of the Prior Art

The present invention is directed generally to the printing field, and more particularly, to an offset printing system including, among other components, a platemaking section or station within which printing plates are produced, and a duplicating station, within which copies are made from the plate. In an automated printing system of this type it is also necessary to provide appropriate structure to automatically transfer the plate from the platemaking station to the duplicating station.

Frequently it happens that the plate is to be oriented differently in the duplicating station than it was in the platemaking station and, when this is the case, the transfer apparatus must be designed to turn or otherwise reorient the plate for receipt by the duplicating station. For example, in the particular system for which the present invention was developed, the transfer apparatus had to be capable of receiving a horizontally oriented plate from the platemaker and to then turn it to a vertical orientation while additionally rotating it by 90° along the transporting axis for presentation to the duplicator.

In the prior art, a reorientation such as this is usually accomplished by means of a series of belts arranged in a tortuous path to carry the plate gradually into the desired orientation.

Such systems are obviously not fully adequate for a variety of reasons. For one thing, they require a substantial amount of space. Secondly, they tend to be quite expensive and add significantly to the total cost of the system. Furthermore, because they are designed to carry the plate along a fairly complex path requiring skewed rollers and the like, they are quite susceptible to jamming problems necessitating a system shutdown, and frequently warp, fray or otherwise damage the plate as well.

SUMMARY OF THE INVENTION

In accordance with the present invention, a novel transfer apparatus is provided which is capable of reorienting a printing plate from a first horizontal orientation to receive a plate to a second orientation that is both vertical and rotated 90° relative to the first orientation to dispense the plate. In accordance with a presently most preferred embodiment of the invention, the transfer apparatus comprises what may be termed a receptor bin for receiving and supporting the plate, the receptor bin itself being supported for movement on a single rotatable shaft. More particularly, and as will become more apparent hereinafter, the shaft is coupled to the base of the receptor bin and extends from it in a specific angular orientation selected such that by merely rotating the shaft about its own axis, the receptor bin will be caused to move in a path that will carry it from the first horizontal orientation to the second vertical and rotated orientation. When the bin is in the first orientation, it will be aligned to receive a printing plate from the platemaking station. The shaft is then rotated through part of a turn to move the receptor bin to the second orientation where it will be aligned to feed the plate into the duplicating station. The shaft rotation can then be reversed to return the receptor bin to its original orientation for receipt of the next plate.

Thus, by means of the present invention, the complex and cumbersome belt transfer systems employed in the prior art can be eliminated and replaced by a single receptor bin supported on a single rotatable shaft. The result is a highly compact transfer apparatus requiring only a minimum of space, while additionally being relatively inexpensive to construct and highly reliable in operation. Furthermore, since, by the present invention, the receptor bin as a whole is moved to carry the plate rather than the plate being moved along a path relative to the transfer mechanism as in the prior art, the system is not susceptible to jamming nor is there much likelihood of the plate being warped, frayed or otherwise damaged. In particular, in the present invention, if the plate is straight when it enters the receptor bin, it will be straight when it leaves, and this is not always the case in the prior art systems.

Specific details leading to a better understanding of the invention are set out hereinafter in conjunction with the detailed description of the preferred embodiment.

DETAILED DESCRIPTION OF THE PREFERRED EMBODIMENT

Figure 1:
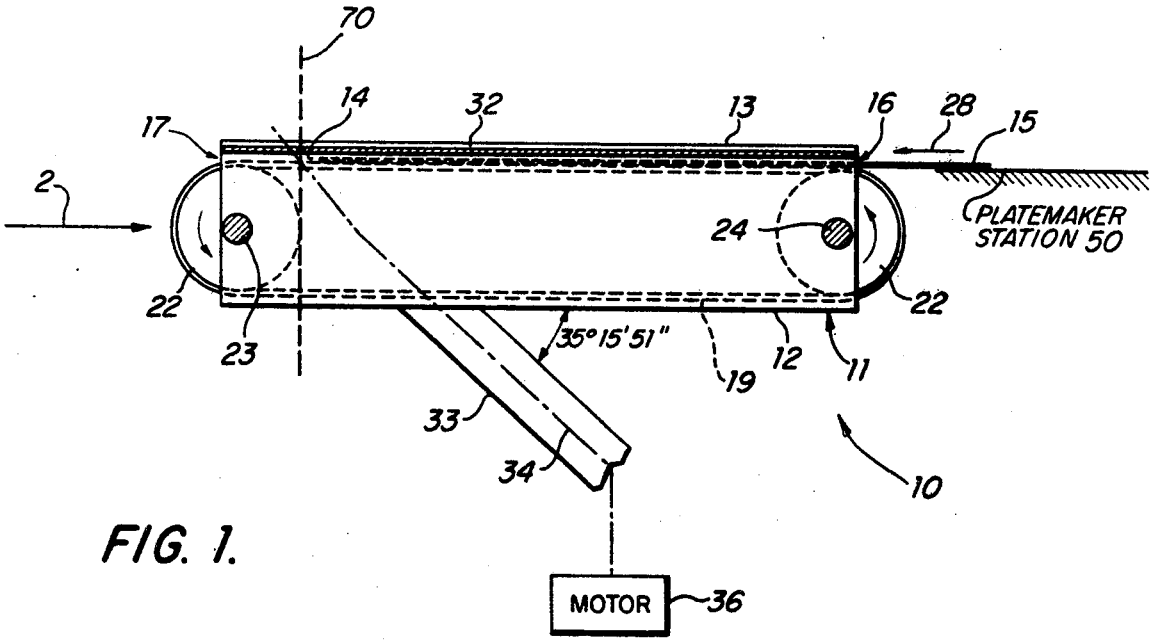
FIG. 1 illustrates, somewhat schematically, the receptor bin according to a preferred embodiment of the invention, looking in the direction of arrow 1-1 of FIG. 2
Figure 2:
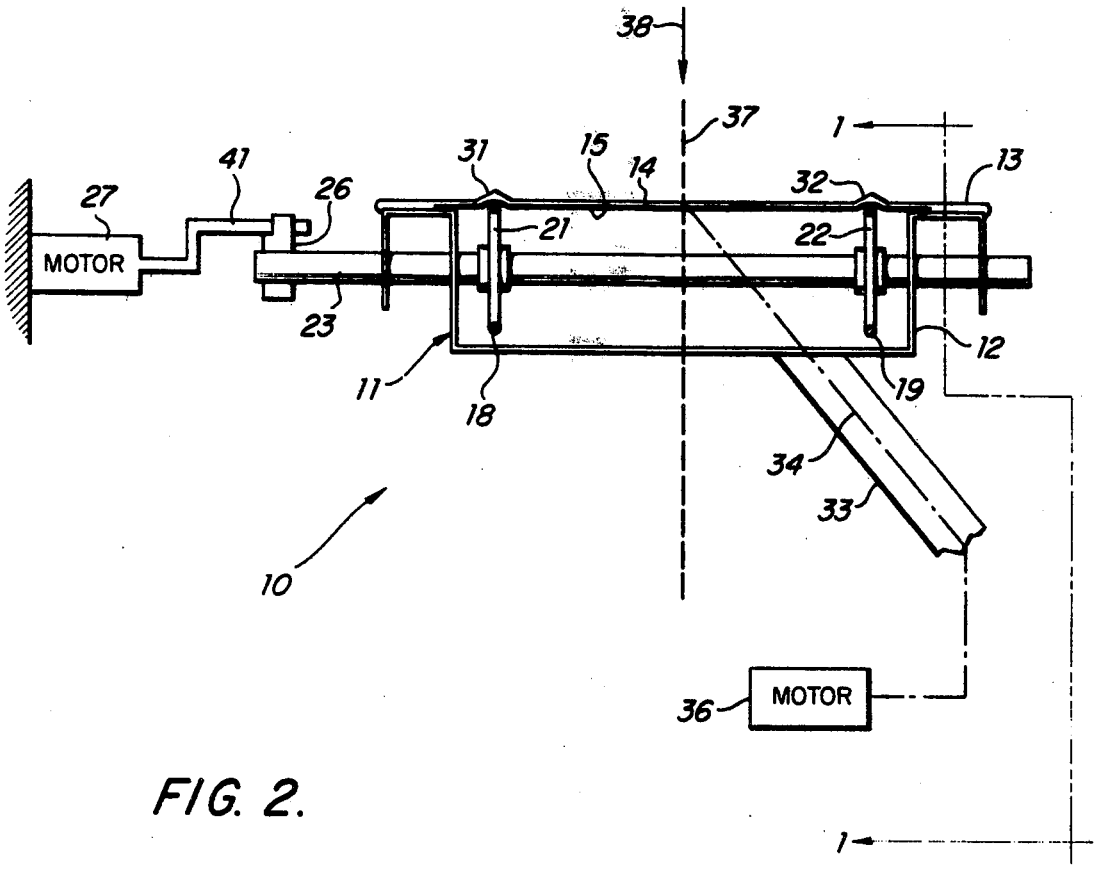
FIG. 2 illustrates the receptor bin looking in the direction of arrow 2 in FIG. 1.

FIGS. 1 and 2 illustrate, somewhat schematically, the transfer apparatus according to a presently preferred embodiment of the invention, with FIG. 1 illustrating a side view of the apparatus in its horizontal orientation, and FIG. 2 showing the apparatus looking in the direction of arrow 2 of FIG. 1. In particular, the transfer apparatus 10 comprises a receptor bin 11 having a housing portion 12 and a cover portion 13, with the cover portion being mounted to the housing to define a slot 14 within which the printing plate 15 is supported.

Within the receptor bin are a pair of endless belts 18 and 19 supported between roller pairs 21 and 22, respectively. The rollers themselves are supported for rotation on shafts 23 and 24 with shaft 23 having an extended portion having a finger 26 mounted on one or both of its ends for releasably coupling the shaft to motors (motor 27 in FIG. 2) for driving the belts. More specifically, FIG. 1 shows a printing plate 15 coming from the platemaking station 50 into the transfer apparatus moving in the direction indicated by arrow 28. The plate is driven into the transfer apparatus through opening 16 by moving belts 18 and 19 until it is supported fully in the apparatus by the belts. A switch or the like can be provided to indicate that the plate is fully within the system. After the receptor bin has been moved to its second orientation, as will be described hereinafter, the belts are again actuated to drive the plate out of the bin through exit slot 17 to the duplicating section along center line 70 as shown in FIG. 1.

To ensure that the plate will be firmly held in the receptor bin 11 during its movement, the cover portion 13 is provided with a pair of longitudinal troughs 31 and 32 aligned with the belts 18 and 19, respectively. As can be seen in FIG. 2, the belts cause the plate to slightly bulge into the troughs so that they will be held firmly in position without permanently deforming them in any way.

Figures 3A, 3B, 3C, 3D:
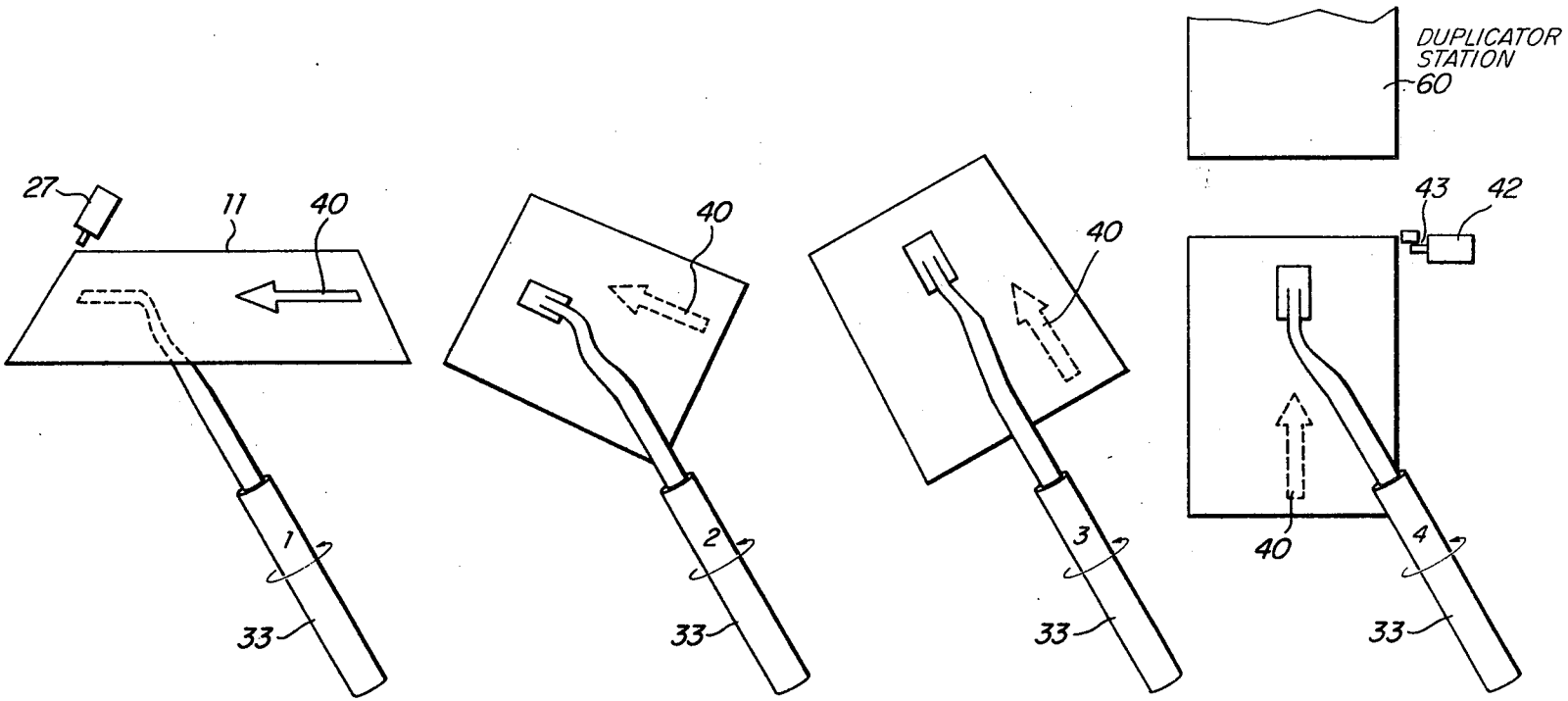
FIGS. 3A, 3B, 3C, and 3D schematically illustrate the movement of the receptor bin in four stages to aid in understanding the present invention.

The receptor bin 11, as a unit, is supported entirely by a single shaft 33 rigidly coupled to the bottom of the housing portion 12. This shaft is adapted to be driven into rotation about its own axis 34 by a motor operated reciprocating drive assembly 36, and, in accordance with the present invention, by mounting the shaft to the receptor bin at a precise orientation, rotation of the shaft in one direction will drive the receptor bin from a first horizontal plate receiving position to a second vertical and rotated plate withdrawal position while reverse rotation will return the bin back to its first horizontal position. In particular, the shaft 33 is coupled to the bottom of housing 12 with reference to three intersecting planes: (1) a center line 37 extending longitudinally from the input end of the housing to the output end of the housing as illustrated in FIG. 2; (2) the plane of slot 14 at center line 37; and (3) the plane of vertical center line 70 at center line 37. The shaft is also angularly oriented relative to the plate support plane of the housing such that it will extend at an acute angle of approximately 45° relative to the center line 37 (looking down in the direction of arrow 38) and at an acute angle of 35° 15′ 51″ relative to the plane of the housing (as shown in FIG. 1). By mounting the shaft to the housing in this particular orientation, it has been found that by merely rotating the shaft about its own axis 33, the receptor bin will be carried in a path that will move it from a first horizontal orientation illustrated in FIGS. 1 and 2 to a second vertical orientation rotated by 90°. This is illustrated more clearly in FIGS. 3A-3D which schematically illustrate the movement of the receptor bin. FIG. 3A illustrates the receptor bin 11 in its first horizontal position wherein it is aligned to receive a plate coming into it from the direction indicated by the arrow 40. This position corresponds to the orientation illustrated in FIGS. 1 and 2. When the plate is fully in the receptor bin, shaft 33 is rotated as indicated in the Figures, and this will move the receptor bin through the orientations illustrated in FIGS. 3B and 3C until it reaches the orientation shown in FIG. 3D. In this orientation, it can be seen that bin 11 is now not only vertical but is also rotated by 90° relative to the FIG. 3A position. In this position, the plate, which is on the back side of bin 11 as shown in FIG. 3D and as indicated by dotted line arrow 40, will be aligned to enter the duplicating station 60 of the station.

When the receptor bin is in the orientation illustrated in FIG. 3A, shaft 23 will be coupled to motor 27 via fingers 26 and 41 (FIG. 2) to cause the belts 18 and 19 to drive the plate into receptor bin 11. When the bin is in the FIG. 3D orientation, shaft 23 will be aligned with and loosely coupled to motor 42 having finger 43 to cause the belts to drive the plate out of bin 11 to the duplicating station in the direction indicated by arrow 40. These motors are mounted to the system housing in the proper location.

After the plate has been withdrawn, shaft 33 is rotated counter-clockwise to return the bin to the FIG. 3A position for receipt of the next plate.

Preferably, the shaft is rotated at a sinusoidally varying velocity by means of a an oscillating drive such that it will accelerate from the stationary FIGS. 3A and 3D positions to a maximum velocity, and then decelerate to a stop at the next position. This enables the system to run more smoothly and reliably. In the system constructed, the transfer apparatus can pick up a plate from the platemaking station, transfer it to the duplicating station and return to pick up the next plate in approximately 10 seconds.

Thus, in summary, with the present invention a system is provided which is capable of transferring a printing plate or other object from a first station to a second station while reorienting the plate from a first horizontal orientation to a second vertical orientation which is additionally rotated by 90°. The system provided is very compact and efficient, and, because it comprises only a single receptor bin supported on a single rotatable shaft, is inexpensive to construct.

While what has been described is a presently most preferred embodiment of the invention, it should be understood that the invention can take a variety of other forms. For example, although the invention has been described for use as a printing plate transfer apparatus, it could easily be employed in a variety of other transfer applications. Accordingly, the invention should be limited only insofar as required by the scope of the following claims.

What is claimed is:

1. In a transfer apparatus for receiving an object from a first station and for transferring said object to a second station, wherein said objects enters said transfer apparatus from said first station moving in a first direction along an input plane and wherein said object leaves said transfer apparatus to said second station moving in a second direction along an output plane different from said first direction and said input plane, said transfer apparatus comprising:

A. receptor means for receiving said object, said receptor means having an input end wherein said object enters said receptor means and an output end opposite said input end wherein said object leaves said receptor means, and wherein said receptor means includes means for defining a substantially planar support surface for supporting said object, said receptor means being movable from a first position aligned with said input plane for receiving said object entering from said first station, to a second position aligned with said output plane for outputting said object to said second station; and B. drives means for moving said receptor means from said first position to said second position, said drive means including:

a. shaft means having a shaft axis coupled to and supporting said receptor means, said shaft means being coupled to said receptor means with reference to a center line extending from said input end to said output end such that said axis intersects said substantially planar support surface at said center line with said axis oriented at a first acute angle relative to said center line, and at a second acute angle relative to said substantially planar support surface, and b. means for rotating said shaft means about its axis, rotation of said shaft means moving said receptor means from said first position to said second position.

2. Apparatus as recited in claim 1 wherein said input plane comprises a horizontal plane and wherein said output plane is vertical and rotated 90° relative to said horizontal plane.

3. Apparatus as recited in claim 2 wherein said first acute angle comprises an angle of approximately 45° and wherein said second acute angle comprises an angle of 35° 11′ 51″.

4. Apparatus as recited in claim 3 wherein said receptor means includes holding means for holding said object on said support surface as said receptor means moves from said first position to said second position.

5. Apparatus as recited in claim 1 wherein said means for defining said substantially planar support surface includes endless belt means for feeding said object onto said receptor means when it is in said first position and for outputting said object from said receptor means when it is in said second position.

6. Apparatus as recited in claim 5 wherein said apparatus comprises means for releasably coupling said belt means to first motor means for driving said belt means when said receptor means is in said first position, and for releasably coupling said belt means to second motor means when said receptor means is in said second position.

7. Apparatus as recited in claim 1 wherein said means for rotating said shaft means comprises oscillating drive means for rotating said shaft means in a first direction to move said receptor means from said first position to said second position. and in a reverse direction to move said receptor means back from said second position to said first position.

8. Apparatus as recited in claim 7 wherein said means for rotating said shaft means comprises means for rotating said shaft at a sinusoidally varying rate as said receptor means moves from said first position to said second position and from said second position back to said first position.

9. Apparatus as recited in claim 1 wherein said object comprises a printing plate.

10. Transfer apparatus for transferring an object from a first station to a second station, said transfer apparatus comprising:

A. receptor means for receiving said object, said receptor means including means for defining a substantially planar support surface for supporting said object, said receptor means being movable from a first horizontal position aligned for receiving said object from said first station to a second position which is both vertical and rotated 90° relative to said first horizontal position and is aligned for outputting said object to said second station; and B. drive means for moving said receptor means from said first position to said second position, said drive means including:

a. shaft means having a shaft axis coupled to and supporting said receptor means, said shaft means being coupled to said receptor means with the axis thereof angularly oriented relative to the plane of said support surface, and b. means for rotating said shaft means about said shaft axis, rotation of said shaft means moving said receptor means from said first position to said second position.

11. Apparatus as recited in claim 10 wherein said object enters said receptor means at an input end thereof and leaves said receptor means at an output end thereof opposite said input end, and wherein said shaft means is coupled to said receptor means with reference to a center line extending from said input end to said output end and wherein said shaft means extends from said receptor means at an angle of approximately 45° relative to said center line and at an angle of 35° 11′ 51″ relative to the plane of said support surface.

12. Apparatus as recited in claim 10 wherein said means for rotating said shaft means comprises oscillating drive means for rotating said shaft means in a first direction to move said receptor means from said first position to said second position, and in a reverse direction to move said receptor means back from said second position to said first position.

13. Apparatus as recited in claim 10 wherein said object comprises a printing plate.

* * * * *